US012429227B2

(12) United States Patent
Neal

(10) Patent No.: US 12,429,227 B2
(45) Date of Patent: Sep. 30, 2025

(54) COOKING APPLIANCE WITH CYCLING OF MULTIPLE GAS BURNERS TO MAINTAIN TEMPERATURE SETPOINT

(71) Applicant: Midea Group Co., Ltd., Foshan (CN)

(72) Inventor: Vern A. Neal, Louisville, KY (US)

(73) Assignee: Midea Group Co., Ltd., Guangdong (CN)

( * ) Notice: Subject to any disclaimer, the term of this patent is extended or adjusted under 35 U.S.C. 154(b) by 533 days.

(21) Appl. No.: 17/891,722

(22) Filed: Aug. 19, 2022

(65) Prior Publication Data

US 2024/0060647 A1 Feb. 22, 2024

(51) Int. Cl.

| | |
|---|---|
| ***F23N 1/00*** | (2006.01) |
| ***F24C 3/12*** | (2006.01) |
| ***F24C 15/32*** | (2006.01) |
| *F23Q 3/00* | (2006.01) |
| *F24C 3/08* | (2006.01) |

(52) U.S. Cl.

CPC ..... *F24C 3/128* (2013.01); *F23N 1/002* (2013.01); *F24C 15/322* (2013.01); *F23N 2227/02* (2020.01); *F23N 2235/12* (2020.01); *F23Q 3/00* (2013.01); *F24C 3/087* (2013.01)

(58) Field of Classification Search

CPC ..... F24C 3/128; F24C 3/087; F24C 15/322; F23N 1/002; F23N 2235/12; F23N 2227/02; F23Q 3/00

USPC ..... 126/39 G

See application file for complete search history.

(56) References Cited

U.S. PATENT DOCUMENTS

| | | | | |
|---|---|---|---|---|
| 2,300,146 | A | 10/1942 | Downe | |
| 3,259,121 | A | 7/1966 | McGee | |
| 4,815,439 | A * | 3/1989 | Houck | A47J 37/00 126/41 R |
| 6,216,683 | B1 * | 4/2001 | Maughan | F23N 5/203 431/70 |
| 6,734,403 | B2 | 5/2004 | Baker et al. | |
| 7,759,617 | B2 | 7/2010 | Bowles et al. | |
| 8,049,142 | B2 | 11/2011 | Blackson et al. | |
| 8,563,901 | B2 | 10/2013 | Hitchcock et al. | |

(Continued)

FOREIGN PATENT DOCUMENTS

| | | |
|---|---|---|
| DE | 4434742 C2 | 1/2001 |
| GB | 1237737 A | 6/1971 |

OTHER PUBLICATIONS

GE Appliances, Gas Range Burner Operation During Bake And Broil, Retrieved From https://www.geappliances.com/ge/service-and-support/support-content.htm, Retrieved on Feb. 17, 2022.

(Continued)

*Primary Examiner* — Avinash A Savani
(74) *Attorney, Agent, or Firm* — Gray Ice Higdon

(57) ABSTRACT

A temperature setpoint is reestablished and maintained in a gas oven using multiple gas burners. In some instances, the multiple gas burners may be cycled using predetermined activation durations for each gas burner when reestablishing the temperature setpoint, and in some instances, the gas burners may be cycled over multiple iterations in order to reestablish the temperature setpoint. Furthermore, in some instances, each gas burner may include a spark igniter that may be used to minimize the amount of time required to ignite the gas burner when reestablishing the temperature setpoint.

20 Claims, 6 Drawing Sheets

(56) References Cited

U.S. PATENT DOCUMENTS

| | | | | |
|---|---|---|---|---|
| 8,776,776 | B2 | 7/2014 | Todd et al. | |
| 8,863,734 | B2 * | 10/2014 | Shaffer ..... | A47J 37/0786 126/39 BA |
| 9,089,005 | B2 | 7/2015 | Boedicker et al. | |
| 10,036,555 | B2 | 7/2018 | Cadima et al. | |

OTHER PUBLICATIONS

Bosch Appliances, Bosh Dual Fuel Range, Use and Care Manual, Retrieved from: chrome-extension://efaidnbmnnnibpcajpcglclefindmkaj/https://c.searspartsdirect.com/mmh/lis_pdf/OWNM/L0609467.pdf, Mar. 2006.

* cited by examiner

COOKING APPLIANCE WITH CYCLING OF MULTIPLE GAS BURNERS TO MAINTAIN TEMPERATURE SETPOINT

BACKGROUND

Cooking appliances that include ovens, e.g., ranges, wall-mounted ovens, and the like, generally incorporate multiple cooking elements disposed at different locations in an oven cavity. One or more bake or baking cooking elements are generally positioned on the bottom or underneath the bottom of the oven cavity, while one or more broil or broiler cooking elements are generally positioned near the top of the oven cavity (for the purpose of simplification, this description will use the term "cooking element" to refer to any of the various heat sources that may be utilized to generate the heat required for cooking, which may include, but are not limited to, resistive electrical heating elements, gas burners, infrared heaters, quartz heaters, etc.) Some cooking appliances may also include multiple ovens, each having multiple cooking burners within, and as such, some cooking appliances may include a multitude of cooking elements disposed therein.

In cooking appliances that rely on electrical cooking elements, maintaining a consistent temperature throughout an oven cavity during a cooking cycle that relies on a temperature setpoint (e.g., a bake, convection, roast, or similar cooking cycle) may be assisted by selectively energizing different cooking elements at different points in the cooking cycle to generate heat in different areas of the oven cavity. In cooking appliances that rely on gas burners as oven cooking elements, however, the gas burners are generally operated using hot surface igniters, and the amount of time required to ignite the gas burners using such hot surface igniters generally precludes any cycling of multiple cooking elements in order to maintain a temperature setpoint. Furthermore, due to airflow constraints, many cooking appliances are not designed to allow multiple gas burners to operate at the same time.

SUMMARY

The herein-described embodiments address these and other problems associated with the art by providing a cooking appliance and method of operation thereof in which a temperature setpoint is reestablished and maintained in a gas oven using multiple gas burners. In some instances, the multiple gas burners may be cycled using predetermined activation durations for each gas burner when reestablishing the temperature setpoint, and in some instances, the gas burners may be cycled over multiple iterations in order to reestablish the temperature setpoint. Furthermore, in some instances, each gas burner may include a spark igniter that may be used to minimize the amount of time required to ignite the gas burner when reestablishing the temperature setpoint.

Therefore, consistent with one aspect of the invention, a cooking appliance may include a housing including an oven cavity, a plurality of gas burners configured to generate heat within the oven cavity, a plurality of gas valves, each gas valve in fluid communication with a respective gas burner among the plurality of gas burners, a plurality of igniters, each igniter positioned proximate to a respective gas burner among the plurality of gas burners and configured to ignite gas supplied to the respective gas burner, and a controller coupled to the plurality of dedicated gas valves and the plurality of igniters, the controller configured to control the plurality of gas valves and the plurality of igniters to maintain a temperature setpoint during a cooking cycle, the controller further configured to reestablish the temperature setpoint during the cooking cycle by controlling the plurality of gas valves and the plurality of igniters to activate each of first and second gas burners among the plurality of gas burners over multiple iterations.

In some embodiments, the first gas burner is a bake gas burner disposed proximate a bottom of the oven cavity and the second gas burner is a broil gas burner disposed proximate a top of the oven cavity. Also, in some embodiments, the plurality of gas burners further includes a convection cooking element, and the controller is configured to, during a first iteration of the multiple iterations performed when reestablishing the temperature setpoint, activate each of the bake gas burner, the broil gas burner and the convection cooking element. Further, in some embodiments, each of the plurality of igniters is a spark igniter.

Some embodiments may further include a plurality of ignition sensors, each ignition sensor positioned proximate to a respective gas burner among the plurality of gas burners and configured to detect ignition of the respective gas burner, and where the controller is configured to confirm activation of each of the first and second gas burners in response to detecting ignition of each of the first and second gas burners with the respective ignition sensors for the first and second gas burners during activation of each of the first and second gas burners.

In some embodiments, each of the plurality of gas valves is a dedicated gas valve, the cooking appliance further includes a shared gas valve in fluid communication with a gas supply and with each of the plurality of dedicated gas valves, and the controller is configured to activate the first gas burner by activating the shared gas valve and the respective dedicated gas valve for the first gas burner to supply gas from the gas supply to the first gas burner, and concurrently activating all of the plurality of igniters while gas is supplied to the first gas burner.

In addition, in some embodiments, the controller is configured to, during a first iteration of the multiple iterations performed when reestablishing the temperature setpoint, sequentially activate the first and second gas burners. In some embodiments, the controller is configured to, during a first iteration of the multiple iterations performed when reestablishing the temperature setpoint, activate the first gas burner for a first predetermined activation duration, and activate the second gas burner for a second predetermined activation duration. In addition, in some embodiments, the controller is configured to, during a first iteration of the multiple iterations performed when reestablishing the temperature setpoint, activate the first gas burner until a temperature in the oven cavity reaches a predetermined temperature, and activate the second gas burner for a predetermined activation duration. Moreover, in some embodiments, the controller is configured to, during a first iteration of the multiple iterations performed when reestablishing the temperature setpoint, activate the first gas burner until a temperature in the oven cavity reaches a first predetermined temperature, and activate the second gas burner until the temperature in the oven cavity reaches a second predetermined temperature.

In some embodiments, the multiple iterations includes at least first and second iterations, and the controller is configured to, during the second iteration, vary an activation sequence, an actuation overlap, a predetermined activation duration of the first gas burner, a predetermined activation duration of the second gas burner, a predetermined temperature at which to deactivate the first gas burner, or a predetermined temperature at which to deactivate the second gas burner relative to the first iteration.

Some embodiments may also include at least one non-gas cooking element disposed in the oven cavity, and the controller is further configured to activate the non-gas cooking element when reestablishing the temperature setpoint. Moreover, in some embodiments, the controller is configured to, during a first iteration of the multiple iterations performed when reestablishing the temperature setpoint, overlap activation of the first and second gas burners during at least a portion of the first iteration. In some embodiments, the cooking cycle is a bake cycle, a convection bake cycle, or a convection roast cycle.

Consistent with another aspect of the invention, a cooking appliance may include a housing including an oven cavity, a plurality of gas burners configured to generate heat within the oven cavity, a plurality of gas valves, each gas valve in fluid communication with a respective gas burner among the plurality of gas burners, a plurality of igniters, each igniter positioned proximate to a respective gas burner among the plurality of gas burners and configured to ignite gas supplied to the respective gas burner, and a controller coupled to the plurality of dedicated gas valves and the plurality of igniters, the controller configured to control the plurality of gas valves and the plurality of igniters to maintain a temperature setpoint during a cooking cycle, the controller further configured to reestablish the temperature setpoint during the cooking cycle by controlling the plurality of gas valves and the plurality of igniters to activate each of first and second gas burners among the plurality of gas burners for respective first and second predetermined activation durations.

In addition, in some embodiments, the first gas burner is a bake gas burner disposed proximate a bottom of the oven cavity and the second gas burner is a broil gas burner disposed proximate a top of the oven cavity. In some embodiments, each of the plurality of igniters is a spark igniter. Moreover, in some embodiments, the controller is configured to activate each of first and second gas burners among the plurality of gas burners for the respective first and second predetermined activation durations during a first iteration among a plurality of iterations performed to reestablish the temperature setpoint during the cooking cycle, and the controller is further configured to activate each of the first and second gas burners during a second iteration among the plurality of iterations performed to reestablish the temperature setpoint during the cooking cycle. Also, in some embodiments, the controller is configured to, during the second iteration, vary an activation sequence, an actuation overlap, a predetermined activation duration of the first gas burner, a predetermined activation duration of the second gas burner, a predetermined temperature at which to deactivate the first gas burner, or a predetermined temperature at which to deactivate the second gas burner relative to the first iteration.

Consistent with another aspect of the invention, a cooking appliance may include a housing including an oven cavity, a plurality of gas burners configured to generate heat within the oven cavity, a plurality of gas valves, each gas valve in fluid communication with a respective gas burner among the plurality of gas burners, a plurality of spark igniters, each spark igniter positioned proximate to a respective gas burner among the plurality of gas burners and configured to ignite gas supplied to the respective gas burner, and a controller coupled to the plurality of dedicated gas valves and the plurality of igniters, the controller configured to control the plurality of gas valves and the plurality of spark igniters to maintain a temperature setpoint during a cooking cycle, the controller further configured to reestablish the temperature setpoint during the cooking cycle by controlling the plurality of gas valves and the plurality of spark igniters to activate each of first and second gas burners among the plurality of gas burners.

Some embodiments may also include a method of operating any of the cooking appliances discussed above.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described example embodiments of the invention. This summary is merely provided to introduce a selection of concepts that are further described below in the detailed description, and is not intended to identify key or essential features of the claimed subject matter, nor is it intended to be used as an aid in limiting the scope of the claimed subject matter.

DETAILED DESCRIPTION

Figure 1:
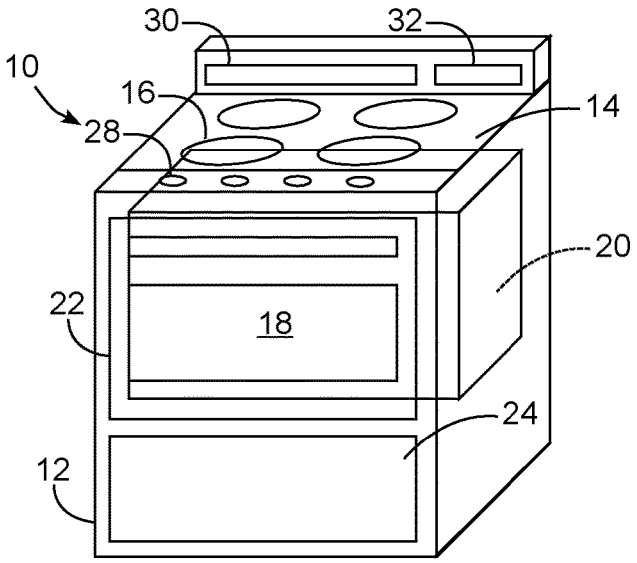
FIG. 1 is a perspective view of a cooking appliance consistent with some embodiments of the invention.

Turning now to the drawings, wherein like numbers denote like parts throughout the several views, FIG. 1 illustrates an example cooking appliance 10 in which the various technologies and techniques described herein may be implemented. Cooking appliance 10 is a residential-type range, and as such includes a housing 12, a stovetop or cooktop 14 including a plurality of burners 16, and an oven 18 defining an oven or cooking cavity 20 accessed via an oven door 22. Cooking appliance 10 may also include a storage drawer 24 in some embodiments, or in other embodiments, may include a second oven. Various cooking elements (not shown in FIG. 1) may also be incorporated into cooking appliance 10 for cooking food in oven 18, e.g., one or more electric or gas cooking elements.

Cooking appliance 10 may also include various user interface devices, including, for example, control knobs 28 for controlling burners 16, a control panel 30 for controlling oven 18 and/or burners 16, and a display 32 for providing visual feedback as to the activation state of the cooking appliance. It will be appreciated that cooking appliance 10 may include various types of user controls in other embodiments, including various combinations of switches, buttons, knobs and/or sliders, typically disposed at the rear or front (or both) of the cooking appliance. Further, in some embodiments, one or more touch screens may be employed for interaction with a user. As such, in some embodiments, display 32 may be touch sensitive to receive user input in addition to displaying status information and/or otherwise interacting with a user. In still other embodiments, cooking appliance 10 may be controllable remotely, e.g., via a smartphone, tablet, personal digital assistant or other networked computing device, e.g., using a web interface or a dedicated app.

Display 32 may also vary in different embodiments, and may include individual indicators, segmented alphanumeric displays, and/or dot matrix displays, and may be based on various types of display technologies, including LEDs, vacuum fluorescent displays, incandescent lights, etc. Further, in some embodiments audio feedback may be provided to a user via one or more speakers, and in some embodiments, user input may be received via a spoken or gesture-based interface.

As noted above, cooking appliance 10 of FIG. 1 is a range, which combines both a stovetop and one or more ovens, and which in some embodiments may be a standalone or drop-in type of range. In other embodiments, however, cooking appliance 10 may be another type of cooking appliance, e.g., a wall mount or freestanding oven. In general, a cooking appliance consistent with the invention may be considered to include any residential-type appliance including a housing and one or more cooking elements disposed therein and configured to generate energy for cooking food within one or more oven cavities.

In turn, a cooking element may be considered to include practically any type of energy-producing element used in residential applications in connection with cooking food, e.g., employing various cooking technologies such as electric, gas, light, microwaves, induction, convection, radiation, etc. In the case of an oven, for example, one or more cooking elements therein may be gas, electric, light, or microwave cooking elements in some embodiments, while in the case of a stovetop, one or more cooking elements therein may be gas, electric, or inductive cooking elements in some embodiments. Further, it will be appreciated that any number of cooking elements may be provided in a cooking appliance (including multiple cooking elements for performing different types of cooking cycles such as baking or broiling, including multiple bake and/or multiple broil cooking elements, as well as one or more convection cooking elements), and that multiple types of cooking elements may be combined in some embodiments, e.g., combinations of microwave and light cooking elements in some oven embodiments.

Figure 2:
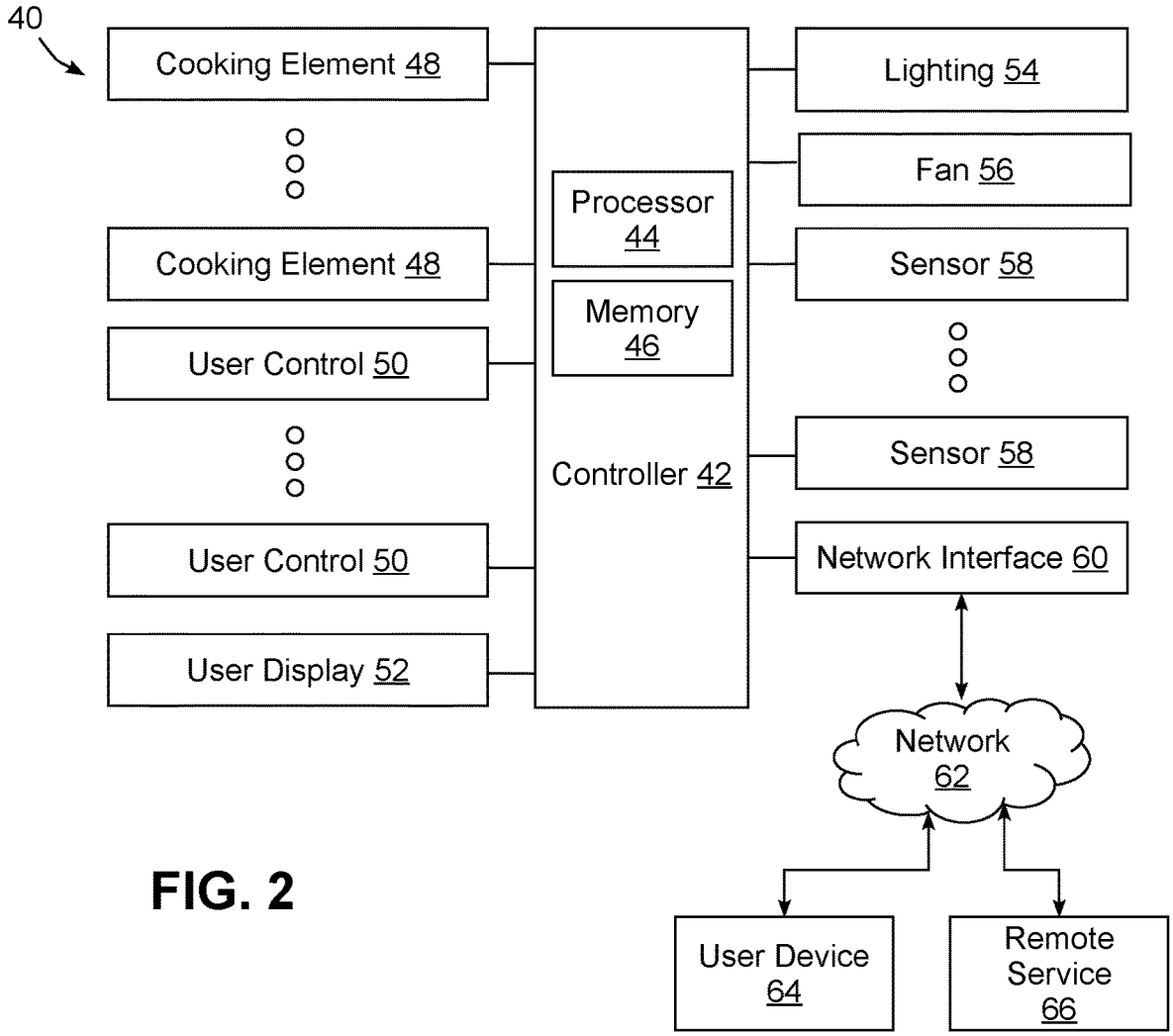
FIG. 2 is a block diagram of an example control system for a cooking appliance consistent with some embodiments of the invention.

A cooking appliance consistent with the invention also generally includes one or more controllers configured to control the cooking elements and otherwise perform cooking operations at the direction of a user. FIG. 2, for example, illustrates an example embodiment of a cooking appliance 40 including a controller 42 that receives inputs from a number of components and drives a number of components in response thereto. Controller 42 may, for example, include one or more processors 44 and a memory 46 within which may be stored program code for execution by the one or more processors. The memory may be embedded in controller 42, but may also be considered to include volatile and/or non-volatile memories, cache memories, flash memories, programmable read-only memories, read-only memories, etc., as well as memory storage physically located elsewhere from controller 42, e.g., in a mass storage device or on a remote computer interfaced with controller 42.

As shown in FIG. 2, controller 42 may be interfaced with various components, including various cooking elements 48 used for cooking food (e.g., various combinations of gas, electric, inductive, light, microwave, light cooking elements, among others), one or more user controls 50 for receiving user input (e.g., various combinations of switches, knobs, buttons, sliders, touchscreens or touch-sensitive displays, microphones or audio input devices, image capture devices, etc.), and a user display 52 (including various indicators, graphical displays, textual displays, speakers, etc.), as well as various additional components suitable for use in a cooking appliance, e.g., lighting 54 and/or one or more fans 56 (e.g., convection fans, cooling fans, etc.), among others.

Controller 42 may also be interfaced with various sensors 58 located to sense environmental conditions inside of and/or external to cooking appliance 40, e.g., one or more temperature sensors, humidity sensors, air quality sensors, smoke sensors, carbon monoxide sensors, odor sensors and/or electronic nose sensors, among others. Such sensors may be internal or external to cooking appliance 40, and may be coupled wirelessly to controller 42 in some embodiments. Sensors 58 may include, for example, one or more temperature sensors for sensing an air temperature within an oven cavity, including, for example, a temperature sensor for sensing temperature in a center of the oven cavity and/or one or more temperature sensors for sensing temperature in the top and/or bottom of the oven cavity.

In some embodiments, controller 42 may also be coupled to one or more network interfaces 60, e.g., for interfacing with external devices via wired and/or wireless networks such as Ethernet, Wi-Fi, Bluetooth, NFC, cellular and other suitable networks, collectively represented in FIG. 2 at 62. Network 62 may incorporate in some embodiments a home automation network, and various communication protocols may be supported, including various types of home automation communication protocols. In other embodiments, other wireless protocols, e.g., Wi-Fi or Bluetooth, may be used. In some embodiments, cooking appliance 40 may be interfaced with one or more user devices 64 over network 62, e.g., computers, tablets, smart phones, wearable devices, etc., and through which cooking appliance 40 may be controlled and/or cooking appliance 40 may provide user feedback. Further, in some embodiments, cooking appliance 40 may be interfaced with one or more remote services 66, e.g., cloud-based services, remote servers.

In some embodiments, controller 42 may operate under the control of an operating system and may execute or otherwise rely upon various computer software applications, components, programs, objects, modules, data structures, etc. In addition, controller 42 may also incorporate hardware logic to implement some or all of the functionality disclosed herein. Further, in some embodiments, the sequences of operations performed by controller 42 to implement the embodiments disclosed herein may be implemented using program code including one or more instructions that are resident at various times in various memory and storage devices, and that, when read and executed by one or more hardware-based processors, perform the operations embodying desired functionality. Moreover, in some embodiments, such program code may be distributed as a program product in a variety of forms, and that the invention applies equally regardless of the particular type of computer readable media used to actually carry out the distribution, including, for example, non-transitory computer readable storage media. In addition, it will be appreciated that the various operations described herein may be combined, split, reordered, reversed, varied, omitted, parallelized and/or supplemented with other techniques known in the art, and therefore, the invention is not limited to the particular sequences of operations described herein.

Numerous variations and modifications to the cooking appliances illustrated in FIGS. 1-2 will be apparent to one of ordinary skill in the art, as will become apparent from the description below. Therefore, the invention is not limited to the specific implementations discussed herein.

Multi-Burner Gas Oven Control System

The ovens used in residential cooking appliances commonly include multiple cooking elements, including one or more bake cooking elements disposed near the bottom of an oven cavity, one or more broil cooking elements disposed near the top of an oven cavity, and in some instances one or more convection cooking elements used with a fan that circulates hot air in a convection cycle. Some cooking appliances also include multiple ovens, so it would not be uncommon for a cooking appliance to include four or more cooking elements.

For gas ovens, where the cooking elements are gas burners supplied by a gas supply, conventionally each gas burner is controlled individually, with its own gas valve controlling gas flow and igniter for igniting the gas burner (typically implemented using a hot surface igniter), as the technology is both common and low cost. However, as the number of gas burners in a cooking appliance increases, it becomes increasingly cost prohibitive to control each gas burner individually.

In some embodiments consistent with the invention, however, a multi-burner gas oven control system may be used to combine the control of multiple gas burners to a single or common control circuit or controller. In a multi-burner gas oven control system, a central gas control mechanism may be used, including a set of shared and dedicated gas valves. A common or shared gas valve allows/prevents gas flow to the dedicated gas valves, and each dedicated gas valve is dedicated to a single gas burner. Thus, in order for gas flow to reach an individual gas burner, both the shared gas valve and that burner's individual dedicated gas valve must be activated.

In addition, in some embodiments, each gas burner may be equipped with its own igniter, and in some embodiments, with its own ignition sensor (e.g., a flame detector), and when any selected gas burner is ignited, the igniters for all gas burners are concurrently activated while gas is supplied to the selected gas burner via the activation of both the shared gas valve and the dedicated gas valve for the selected gas burner.

By concurrently activating all igniters, in the event of a gas valve failure or miswiring of the control system (e.g., wiring the igniter, ignition sensor and/or dedicated gas valve for one gas burner to the control inputs for a different gas burner), ignition of gas unintentionally output by any gas burner will be ignited, rather than building up in the oven cavity. Moreover, where an ignition sensor is used, the ignition sensor may be used to detect the ignition of an unintended gas burner and enable the control system to shut down the oven and/or alert a user of the potential error.

In addition, in some embodiments, a control system may include software and/or hardware to interlock one or more gas burners, such that certain gas burners are not allowed to be operated simultaneously.

Figure 3:
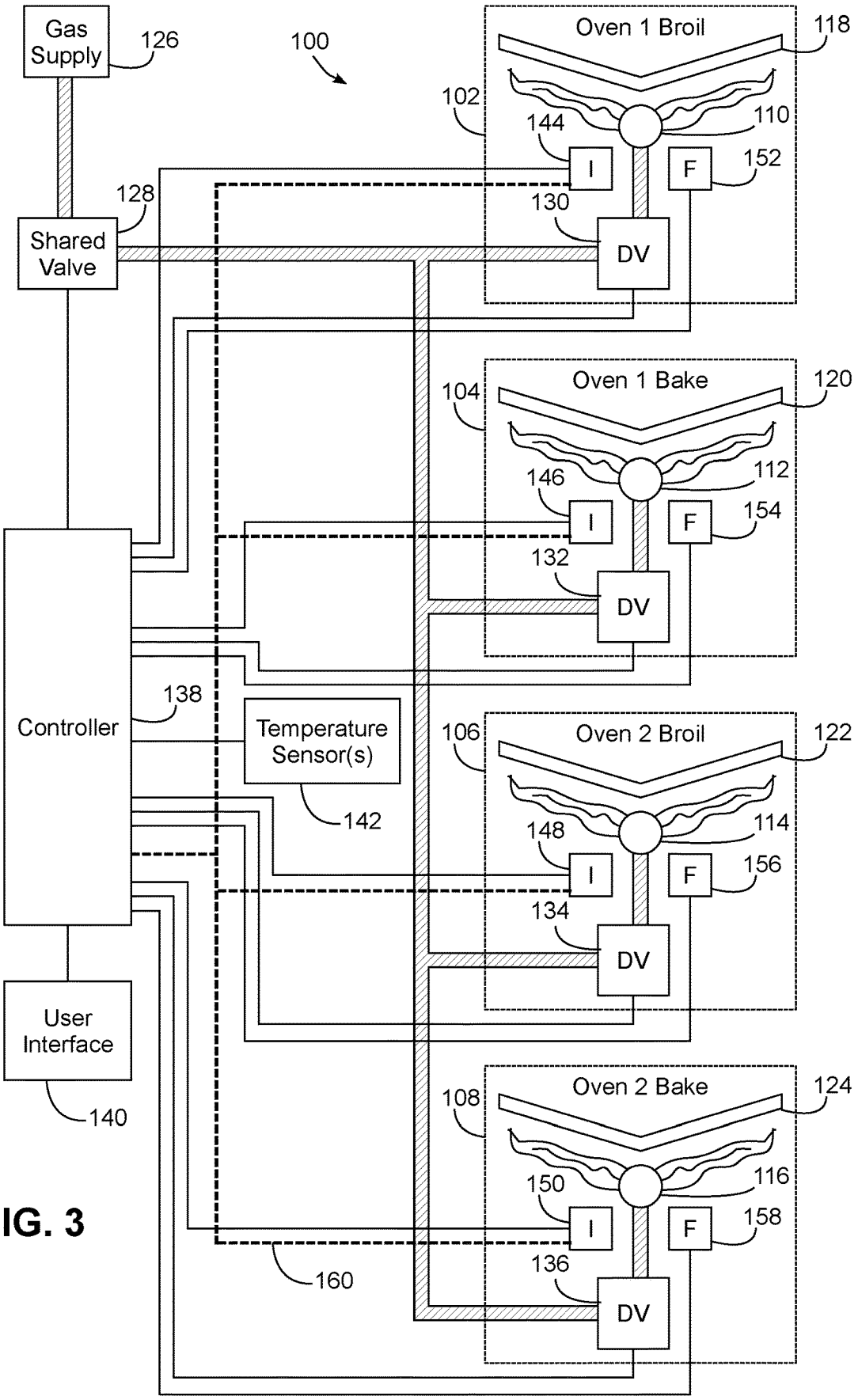
FIG. 3 is a block diagram of an example multi-burner gas oven control system consistent with some embodiments of the invention.

FIG. 3 illustrates an example cooking appliance 100, e.g., a range or wall oven, including a multi-burner gas oven control system consistent with the invention. Cooking appliance 100 includes two oven cavities or ovens, each with bake and broil functionality, represented at 102 (oven 1 broil), 104 (oven 1 bake), 106 (oven 2 broil) and 108 (oven 2 bake). Each includes a respective gas burner 110, 112, 114, 116 and associated flame spreader 118, 120, 122, 124. Gas is supplied to the control system from a gas supply 126 that may be internal or external to the appliance, with a shared gas valve 128 outputting to a set of dedicated gas valves 130, 132, 134, 136 that are dedicated to each of gas burners 110, 112, 114, 116, such that when the shared gas valve 128 is activated along with one of the dedicated gas valves 130, 132, 134, 136, the respective gas burner 110, 112, 114, 116 is in fluid communication with gas supply 126. The gas lines representing the gas flow paths from gas supply 126 to gas burners 110, 112, 114, 116 are shown in cross-hatching.

A controller 138, e.g., a microprocessor, a microcontroller, a control circuit, etc. (including any supporting hardware circuitry), is electrically coupled to each gas valve 128-136 to selectively activate each gas valve 128-136. In some embodiments, each gas valve 128-136 is an on/off valve, such that each gas burner has a fixed output power or level. In other embodiments, any of gas valves 128-136 may be variable gas valves, or additional variable gas valves may be included in the gas flow paths, in order to regulate the output level of one or more of the gas burners.

Controller 138 may also be coupled to a user interface 140, e.g., a display, one or more indicators, a touch screen, a set of physical controls such as buttons, switches, knobs, etc., a remote device such as a mobile device, or any other suitable technology for receiving user input and/or displaying data to a user. Through user interface 140, for example, a user may select a cooking temperature or output level, a cycle type (e.g., bake, broil, convection bake, convection roast, etc.), a cycle duration, a delay duration, or any other settings that may be appropriate for a desired oven cooking cycle. In addition, one or more temperature sensors 142 may be disposed in each oven cavity to sense current temperature in the oven cavity.

Each gas burner 110, 112, 114, 116 also includes a respective igniter 144, 146, 148, 150 and a respective ignition sensor 152, 154, 156, 168. Each igniter 144, 146, 148, 150 may be a direct igniter such as a spark igniter in some embodiments, while in other embodiments, a proven igniter such as a hot surface igniter may be used, whereby each igniter remains active the entire time gas is flowing. Each ignition sensor 152, 154, 156, 158 may be implemented using a flame detector or another suitable technology for sensing ignition of a gas burner, or may be omitted in some embodiments. In addition, while controller 138 is illustrated as having separate control outputs routed to the individual igniters 144, 146, 148, 150 to support individual control thereof, in other embodiments, and as illustrated by dashed line 160, the igniters 144, 146, 148, 150 may be controlled by the same control output, e.g., generated by controller 138 or a separate ignition module. In addition, it will be appreciated that in some embodiments, an igniter and an ignition sensor may be integrated into the same component that performs both functions.

Figure 4:
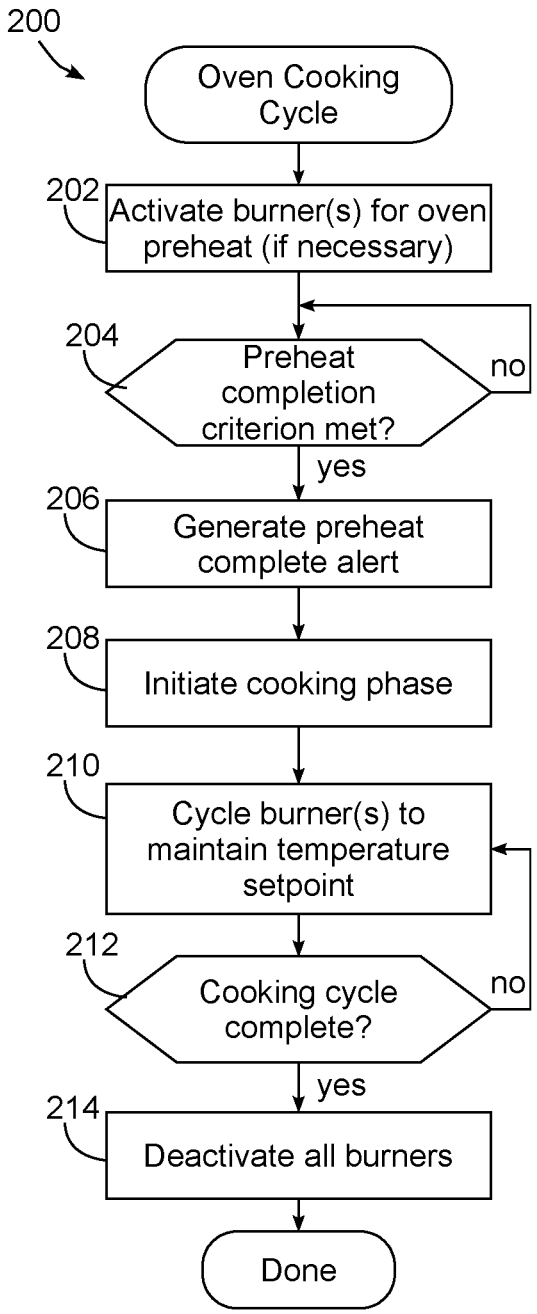
FIG. 4 is a flowchart illustrating an example sequence of operations for performing a cooking cycle using the multi-burner gas oven control system of FIG. 3.

FIG. 4 next illustrates an example sequence of operations 200 for performing an oven cooking cycle, for example, using controller 138 of FIG. 3 and in response to user input selecting various settings for the oven cooking cycle and requesting that the oven cooking cycle be started. Assuming, for the purposes of this example, that the selected oven cooking cycle has a desired temperature setpoint and thus requires a preheat phase to enable the oven to reach that desired temperature setpoint, block 202 activates the appropriate gas burner(s) in the appropriate oven to initiate the preheat phase. Block 204 waits until a preheat completion criterion has been met (e.g., the oven cavity temperature reaching the desired temperature setpoint), and once the criterion is met, control passes to block 206 to generate a preheat complete alert, e.g., an audible beep, a message on a display, a message on a mobile device, etc. Next, in block 208 the cooking phase is initiated, and in block 210, one or more of the gas burners is cycled (i.e., selectively activated and/or deactivated) to maintain the desired temperature setpoint in the oven cavity, e.g., using one or more temperature reestablishment operations as discussed below. While the cooking cycle is ongoing, block 212 returns control to block 210 to continuing the cycling of the gas burner(s), but once the cooking cycle is complete, e.g., as a result of a completion duration being met, or as a result of a user turning off the oven, control passes to block 214 to deactivate all gas burners used in the cooking cycle, and the cooking cycle is complete. Deactivating all gas burners, in this regard, may include deactivating or shutting off the dedicated gas valve(s) for the gas burner(s) used in the cooking cycle, deactivating or shutting off any igniters for the gas burner(s) used in the cooking cycle (e.g., if proven igniters are used), and if no other cooking cycles are still active, deactivating or shutting off the shared gas valve.

Figure 5:
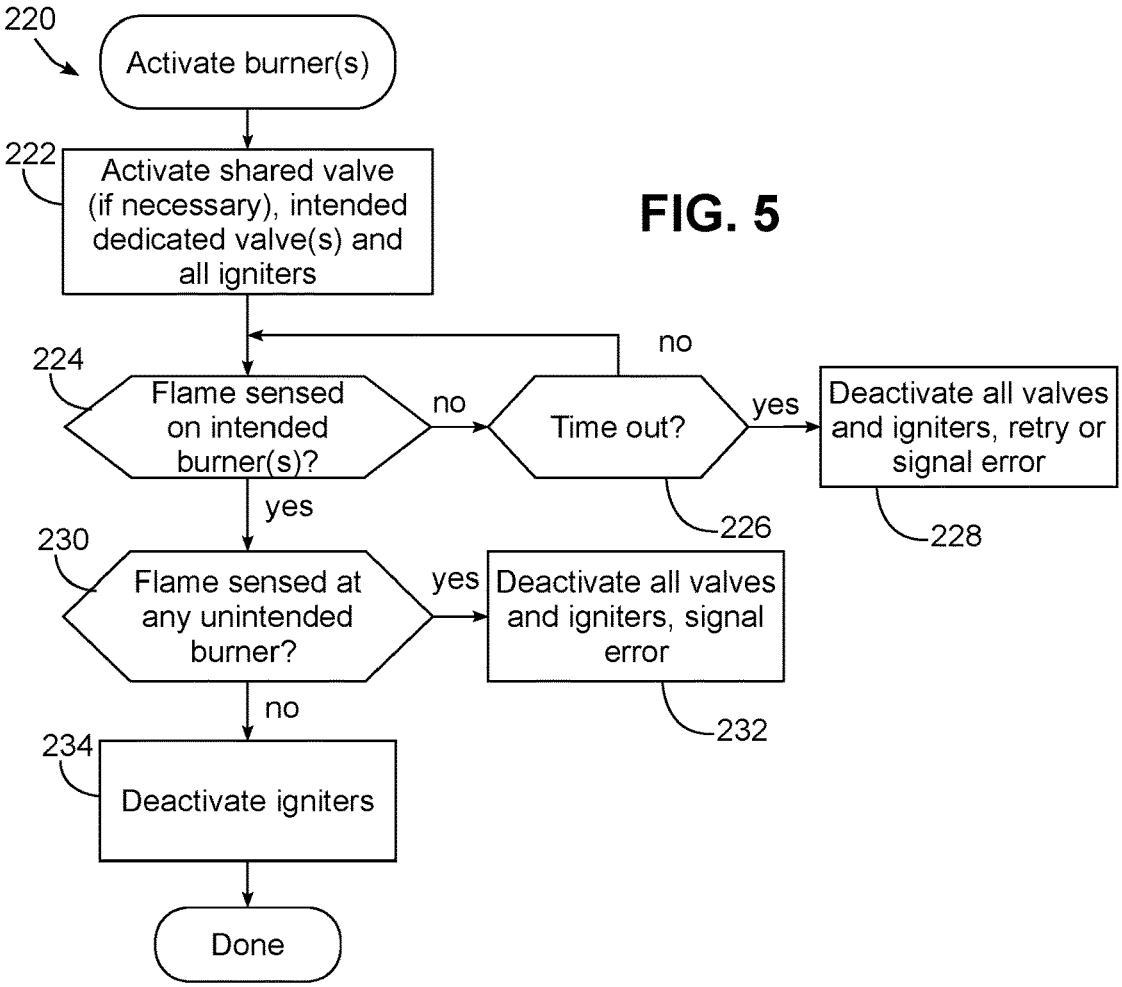
FIG. 5 is a flowchart illustrating an example sequence of operations for activating a gas burner in the sequence of operations of FIG. 4.

FIG. 5 next illustrates an example sequence of operations 220 suitable for use in some embodiments for activating one or more gas burners, e.g., during block 202 (preheat phase) or block 210 (cooking phase) of FIG. 4. For the purposes of this example, each gas burner desired to be activated may be referred to as an intended or selected gas burner, while a gas burner for which no activation is desired or expected may be referred to as an unintended gas burner. Also for the purposes of this example, it is assumed that the igniters are direct igniters, and ignition sensors are also used.

First, in block 222, the shared gas valve is activated if necessary (e.g., if no other gas burners are currently active) along with the dedicated valve(s) for all intended gas burners (thereby establishing gas flow to each intended gas burner). In addition, the igniters for all gas burners (both intended and unintended) are activated. It will be appreciated that these operations may occur concurrently in some embodiments, while in other embodiments, different sequences may be used, e.g., to change the order in which the dedicated gas valve(s), shared gas valve and igniter(s) are activated (for example, to start the igniters shortly before establishing gas flow to the gas burner(s).

Block 224 next enters a loop to wait for the intended gas burner(s) to ignite, and polls all of the ignition sensors for the intended gas burners to attempt to confirm that all of the intended gas burners are ignited. If not, control passes to block 226 to determine if a time out has occurred, i.e., based upon a predetermined timer duration from the beginning of the activation effort. If a time out has occurred, then successful ignition has not occurred within the predetermined timer duration, so block 226 passes control to block 228 to deactivate all gas valves and igniters. In the alternative, if, for example, another cooking cycle is in progress in another oven, only a subset of the dedicated gas valves may be deactivated in block 228, thereby allowing the other cooking cycle to continue. Also, at this time, activation may be re-attempted one or more times in some embodiments, with a delay between activation attempts optionally used in some embodiments to allow for uncombusted gas in the oven cavity to disperse.

Further, in addition to or in lieu of performing additional attempts, an error may be signaled in block 228, e.g., by generating a user notification such as an audible alert, a message on a display, a message on a mobile device, etc. In addition, in some embodiments the user notification may include an identification of any gas burners involved in the activation attempt, e.g., "ignition failure detected for oven 1 broil burner, retrying."

Returning to block 224, if successful ignition has been confirmed for all intended gas burners, control passes to block 230 to poll the ignition sensors for all other gas burners to determine if a flame has been sensed at any of these unintended gas burners. Ignition or activation of an unintended gas burner could potentially occur, for example, if the control wires for the dedicated gas valve for the unintended gas burner were miswired or shorted to those of another gas valve, or if the dedicated gas valve for the unintended gas burner was stuck in an open state. Thus, if any unintended gas burner is found to be activated, block 230 passes control to block 232 to deactivate all gas valves (or at least the shared gas valve) and igniters and signal an error. In some instances, the deactivation may be limited to the gas burners in the affected oven cavity, while in other instances, it may be desirable to effectively disable all gas burners until the cooking appliance can be serviced. The signaled error may include, for example, a user notification such as an audible alert, a message on a display, a message on a mobile device, a message to a service organization, etc. In addition, in some embodiments the user notification may include an identification of the unintended gas burner that was activated, e.g., "unexpected ignition detected for oven 1 broil burner, oven has been disabled".

Returning to block 230, if no activated unintended gas burners were detected, control passes to block 234 to deactivate the igniters, whereby all intended gas burners have been successfully activated. Sequence 220 is then complete.

Numerous variations and modifications to the multi-burner gas oven control system illustrated in FIGS. 3-5 will be apparent to one of ordinary skill in the art, as will become apparent from the description below. Therefore, the invention is not limited to the specific implementations discussed herein.

Cycling of Multiple Gas Burners to Maintain Temperature Setpoint

The use of a single cooking element to maintain a temperature setpoint in an oven can result in temperature variations in the oven and uneven cooking of food. While bake cycles are the most common type of cooking cycles that utilize temperature setpoints, it will be appreciated that a number of cooking appliances support additional types of similar cycles, such as roast, convection bake, convection roast, warm, and proof, among others.

In this regard, maintaining a temperature setpoint generally involves the temporary activation of the cooking element from time to time in order to keep the temperature in the oven substantially close to the temperature setpoint, after a preheat phase in which the oven has been initially heated to the temperature setpoint. In many ovens, maintaining a temperature setpoint involves heating the oven with the cooking element until the temperature setpoint has been reached, and then deactivating the cooking element and allowing the temperature in the oven to drop slowly over time until the temperature drops a predetermined amount from the temperature setpoint, generally established either in absolute (e.g., 10 degrees) or relative (e.g., 5%) terms. Once the temperature has dropped this predetermined amount, the heating element is again activated until the oven heats back up to the temperature setpoint. This process is generally repeated throughout the cooking cycle, until either the user shuts off the oven or a timer has determined that the cooking cycle is complete. For the purposes of this disclosure therefore maintaining a temperature setpoint may be considered to include one or more operations, referred to herein as temperature reestablishment operations, that seek to reestablish the temperature setpoint after the temperature in the oven has dropped sufficiently below the temperature setpoint, e.g., a reactivation temperature that is determined either based upon an absolute or relative decrease from the temperature setpoint.

It has been found, for example, that during a bake cycle, the use of the bake cooking element alone can result in a higher temperature in a lower portion of an oven cavity than in an upper portion of the upper cavity, causing faster cooking and/or browning of the bottom of food being cooked. By using multiple cooking elements, e.g., both bake and broil cooking elements, a more even temperature distribution can generally be obtained; however, in gas ovens, design limitations often make the use of multiple gas burners impractical. Air flow and other concerns generally preclude the simultaneous use of bake and broil gas burners in many gas ovens. Furthermore, the conventional hot surface igniters that are generally used in many gas ovens often take a substantial amount of time to active or ignite a gas burner, e.g., 60 seconds or more, which often makes switching between multiple gas burners impractical for maintaining a temperature setpoint due to the relatively short period of time that heating is required in order to reestablish the temperature setpoint after the temperature has dropped to the reactivation temperature.

In some embodiments consistent with the invention, however, spark igniters may be used in lieu of hot surface igniters to substantially reduce the time required to re-ignite a gas burner from 60+ seconds to generally less than 5 seconds, and thereby enable multiple gas burners to be utilized in temperature reestablishment operations, and in some instances by activating each gas burner multiple times and/or in multiple iterations (i.e., where each iteration includes the activation of one or more gas burners, such that, within a particular temperature reestablishment operation, at least one gas burner is activated multiple times). By doing so, improved baking performance and evenness of food browning can more generally be achieved.

Figure 6:
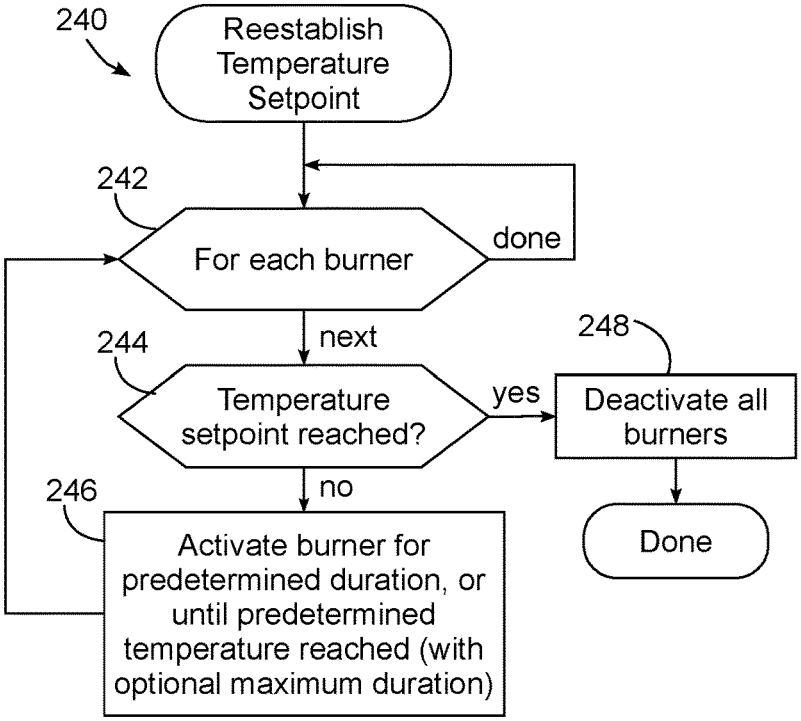
FIG. 6 is a flowchart illustrating an example sequence of operations for reestablishing a temperature setpoint in the sequence of operations of FIG. 4.

As illustrated by sequence of operations 240 of FIG. 6, for example, a temperature reestablishment operation in some embodiments may sequentially activate two or more gas burners one or more times each and over one or more iterations in order to reestablish a temperature setpoint in an oven cavity. As will become more apparent below, in other embodiments, the activation of multiple gas burners may be overlapped in some embodiments, but in the embodiment of FIG. 6, only one gas burner is activated at any given time.

Sequence 240 may be executed, for example, by controller 138 of FIG. 3 after the sensed temperature in an oven cavity falls below a reactivation temperature associated with a temperature setpoint for a cooking cycle being performed in the oven cavity, e.g., during block 210 of FIG. 4. In block 242, a loop is performed to sequence between a plurality of gas burners involved in the temperature reestablishment operation, e.g., bake and broil gas burners, and in some instances, additional burners and/or non-gas cooking elements that may also be used to heat the oven cavity such as gas or non-gas convection cooking elements. For each involved burner or cooking element, control passes to block 244 to first determine if the temperature setpoint has yet been reached. Assuming that initially that setpoint has not been reached, block 244 passes control to block 246 to activate the burner.

Activation of the burner in block 246 may include, for example, activating the shared and dedicated valves and spark igniter for the burner, as discussed above in connection with FIG. 6. The duration that the burner is activated may then be controlled based upon either reaching a predetermined activation duration or reaching a predetermined temperature. In addition, in some instances, where a predetermined temperature is used to control the duration of the burner activation, a maximum activation duration may also be used, such that the burner will be deactivated after the maximum activation duration even if the predetermined temperature has not been reached. Upon conclusion of block 246, the burner is then deactivated.

Block 246 then returns control to block 242 to process the next burner involved in the temperature reestablishment operation, and once all involved burners have been activated, the iteration is complete and block 242 initiates a next iteration. Thus, one or more iterations of the loop of blocks 242-246 are performed until block 244 determines that the temperature setpoint has been reached. At this point, block 244 passes control to block 248 to deactivate all burners, and the temperature reestablishment operation is complete.

It will be appreciated that the duration of each gas burner's activation may be static over multiple iterations, or may be varied in different iterations. Where a specific activation duration is used, for example, the duration may be a static value, or may be determined dynamically, e.g., at the initiation of a temperature reestablishment operation or during each iteration. The activation duration may also be different for each gas burner. In one embodiment, for example, a bake gas burner may be activated for 15 seconds and a broil gas burner may be activated for 10 seconds in each iteration.

Moreover, when a predetermined temperature is used to control the duration of activation, the predetermined temperature may be determined in different manners, e.g., based on static values, dynamically determined at the initiation of a temperature reestablishment operation, or dynamically determined during each iteration. In one embodiment, for example, predetermined temperatures may be determined during each iteration based upon the difference between the current sensed temperature and the temperature setpoint (e.g., where the current temperature is 380° F. (degrees Fahrenheit) and the temperature setpoint is 400° F., perform one iteration activating the bake gas burner until the current temperature is 385° F. and activating the broil gas burner until the current temperature is 390° F., and then performing a second iteration activating the bake gas burner until the current temperature is 395° F. and activating the broil gas burner until the current temperature is 400° F.).

It will also be appreciated that some gas burners may be temperature-based, while others may be duration-based, and which gas burners are temperature-based and which are duration-based may vary from iteration to iteration. Additional variations may occur between different iterations, e.g., such that during an iteration, one or more of an activation sequence (i.e., the order in which burners are activated), an actuation overlap (i.e., a duration in which two or more burners are concurrently activated), a predetermined activation duration of one or more gas burners, a predetermined temperature at which to deactivate one or more gas burners, etc. may be varied relative to an earlier iteration.

Figure 7:
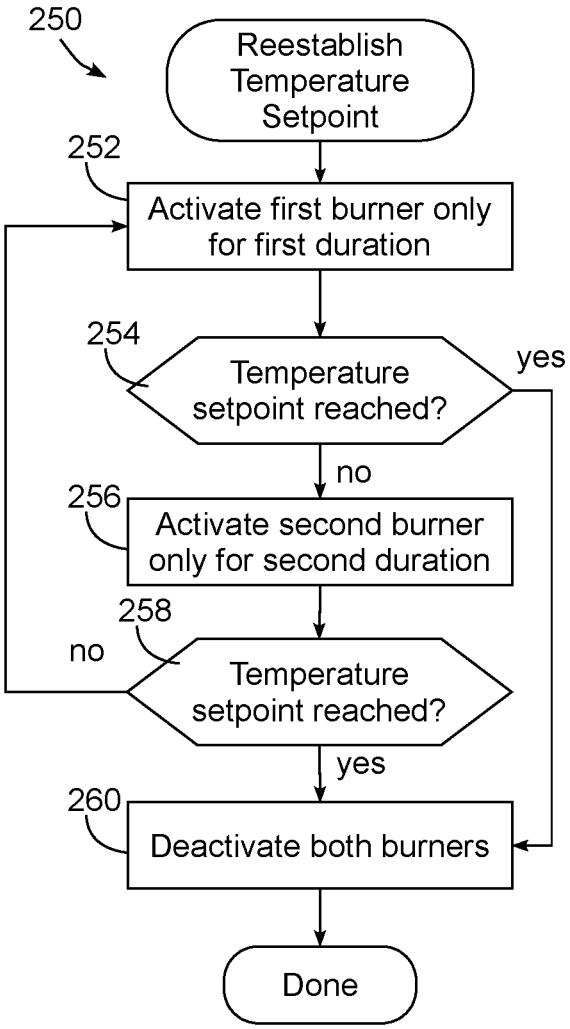
FIG. 7 is a flowchart illustrating another example sequence of operations for reestablishing a temperature setpoint in the sequence of operations of FIG. 4.

FIG. 7 illustrates another sequence of operations 250 that is strictly activation duration based, and for use with two gas burners, e.g., a bake gas burner and a broil gas burner, and that is capable of being performed by controller 138 of FIG. 3, e.g., during block 210 of FIG. 4. In this sequence, which is initiated in response to the sensed temperature in an oven cavity falling below the reactivation temperature associated with the temperature setpoint for the cooking cycle being performed in the oven cavity, it is assumed that the sequence in which the gas burners are activated is the same for each iteration. It is also assumed for the purposes of this sequence that each gas burner is activated for a predetermined activation duration that is static for all iterations, e.g., 20 seconds for each of the bake and broil gas burners.

Thus, in block 252, the first gas burner (e.g., the bake gas burner) is activated for its predetermined activation duration, and with the second gas burner (e.g., the broil gas burner) deactivated. After this activation duration has passed, the first gas burner is deactivated, and control then passes to block 254, where the current temperature is checked (e.g., with an oven temperature sensor) to determine if the temperature setpoint has been reached. If not, control passes to block 256, where the second gas burner (e.g., the broil gas burner) is activated for its predetermined activation duration, and with the first gas burner (e.g., the bake gas burner) deactivated. After this activation duration has passed, the second gas burner is deactivated, and control then passes to block 258, where the current temperature is again checked (e.g., with an oven temperature sensor) to determine if the temperature setpoint has been reached. If not, the current iteration is complete, and control passes to block 252 to initiate a next iteration to sequentially activate the first and second gas burners.

If the current temperature is determined to reach the temperature setpoint in either block 254 or block 258, control passes to block 260 deactivate both gas burners, and the temperature reestablishment operation is complete.

Figure 8:
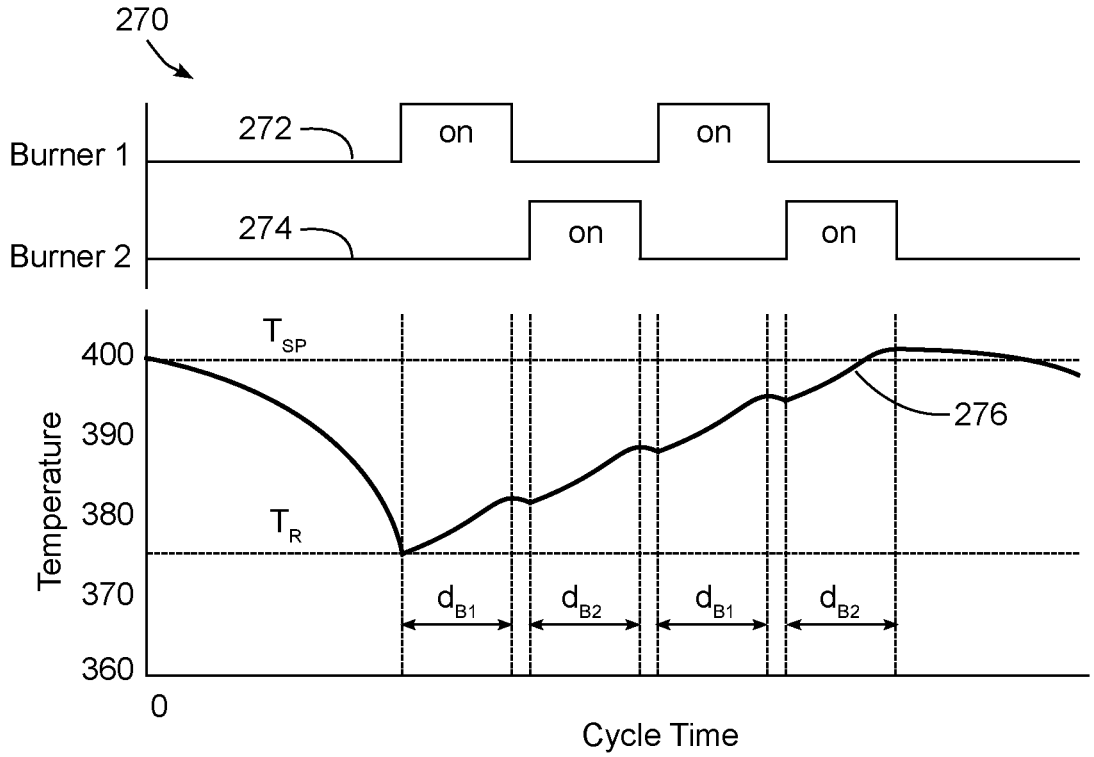
FIG. 8 is a graph illustrating an example temperature reestablishment operation performed using the sequence of operations of FIG. 7.

FIG. 8 next illustrates an example graph 270 illustrating an example temperature reestablishment operation performed using sequence 250 of FIG. 7. Lines 272 and 274, in particular illustrate activation/deactivation states over time for a pair of burners (burner 1 for line 272 and burner 2 for line 274), while line 276 illustrates oven cavity temperature over time. In this example, a temperature setpoint $T_{SP}$ is set at 400° F., with a reactivation temperature set 25° F. below the temperature setpoint, or 375° F. Temperature line 276 shows an initial temperature at the temperature setpoint $T_{SP}$, e.g., subsequent to a preheat operation or a prior temperature reestablishment operation. Over time, the temperature in the oven drops until it reaches the reactivation temperature $T_R$, and at that point sequence 250 may be initiated, activating each of burners 1 and 2 sequentially for respective activation durations of $d_{B1}$ for burner 1 and $d_{B2}$ for burner 2. Assuming that at the end of the activation of burner 2 in the second iteration, the oven cavity temperature has reached the temperature setpoint $T_{SP}$, the sequence may terminate and the temperature reestablishment operation is complete. The temperature is then allowed to fall until the reactivation temperature $T_R$ is reached, at which point sequence 250 may be repeated.

Figure 9:
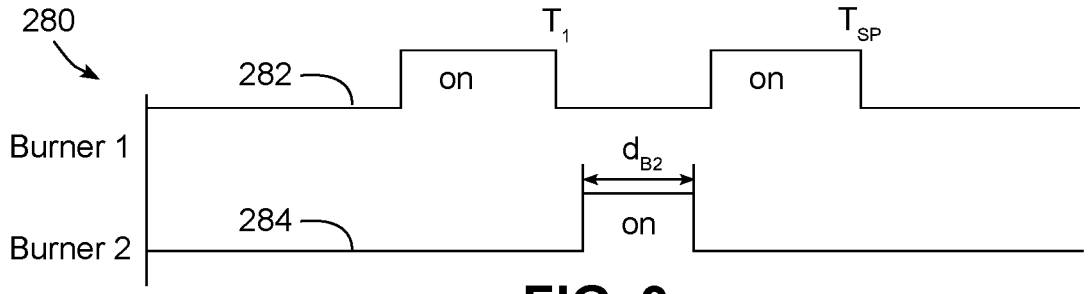
FIGS. 9 and 10 are graphs illustrating example activation/deactivation states of various burners and/or cooking elements that may be used to reestablish a temperature setpoint in the sequence of operations of FIG. 4.

As noted above, activation durations of each burner may be based on predetermined durations and/or predetermined temperatures being reached, and moreover, activation durations of burners may vary from iteration to iteration, and even the sequence or number of burners involved may vary from iteration to iteration. FIG. 9, for example, illustrates a graph 280 with a line 282 showing the activation/deactivation state of a burner 1 that is temperature-based, and a line 284 showing the activation/deactivation state of a burner 2 that is predetermined duration-based. Thus, as may be seen in FIG. 9, during a first iteration of a temperature reestablishment operation, burner 1 may be activated until a predetermined temperature Ti is reached, then burner 2 may be activated for a predetermined activation duration of $d_{B2}$. In a second iteration, only burner 1 is activated, and the duration of its activation is until the temperature setpoint $T_{SP}$ is reached.

Figure 10:
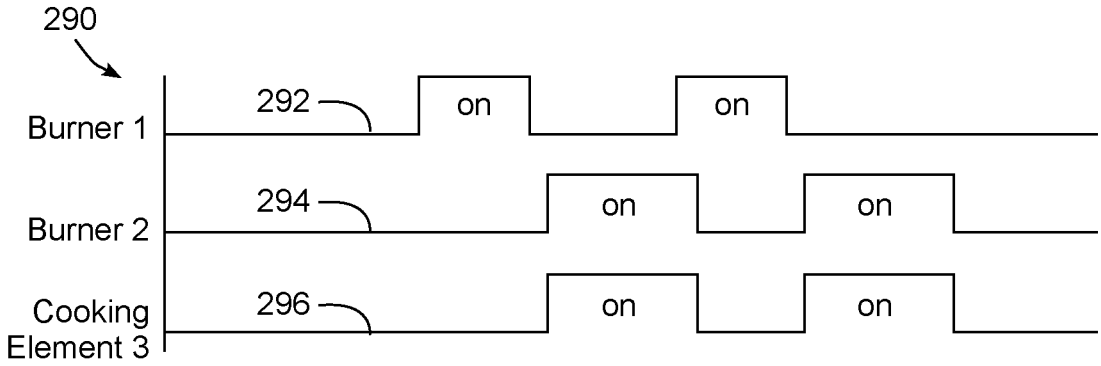

FIG. 10, as another example, illustrates a graph 290 with a line 292 showing the activation/deactivation state of a burner 1, a line 294 showing the activation/deactivation state of a burner 2, and a line 296 showing the activation/deactivation state of a cooking element 3. In this example, any of burners 1-2 and cooking element 3 may be temperature-based or predetermined duration-based, and moreover, as illustrated in FIG. 9, in some embodiments the activation of multiple burners/cooking elements may overlap in time. Furthermore, it will be appreciated that cooking element 3 may be a gas burner in some embodiments, or may be a non-gas cooking element in other embodiments. For example, in some embodiments, where an electrical convection cooking element is used, it may be desirable to activate the convection cooking element concurrently with one of the gas burners.

It will be appreciated that various modifications may be made to the embodiments discussed herein, and that a number of the concepts disclosed herein may be used in combination with one another or may be used separately. Therefore, the invention lies in the claims hereinafter appended.

What is claimed is:

1. A cooking appliance, comprising:

a housing including an oven cavity;

a plurality of gas burners configured to generate heat within the oven cavity;

a plurality of gas valves, each gas valve in fluid communication with a respective gas burner among the plurality of gas burners;

a plurality of igniters, each igniter positioned proximate to a respective gas burner among the plurality of gas burners and configured to ignite gas supplied to the respective gas burner; and a controller coupled to the plurality of dedicated gas valves and the plurality of igniters, the controller configured to control the plurality of gas valves and the plurality of igniters to maintain a temperature setpoint during a cooking cycle, the controller further configured to reestablish the temperature setpoint during the cooking cycle by controlling the plurality of gas valves and the plurality of igniters to activate each of first and second gas burners among the plurality of gas burners over multiple iterations, and to deactivate the first gas burner between first and second activations of the first gas burner over the multiple iterations.

2. The cooking appliance of claim 1, wherein the first gas burner is a bake gas burner disposed proximate a bottom of the oven cavity and the second gas burner is a broil gas burner disposed proximate a top of the oven cavity.

3. The cooking appliance of claim 2, wherein the plurality of gas burners further includes a convection cooking element, and wherein the controller is configured to, during a first iteration of the multiple iterations performed when reestablishing the temperature setpoint, activate each of the bake gas burner, the broil gas burner and the convection cooking element.

4. The cooking appliance of claim 1, wherein each of the plurality of igniters is a spark igniter.

5. The cooking appliance of claim 1, further comprising a plurality of ignition sensors, each ignition sensor positioned proximate to a respective gas burner among the plurality of gas burners and configured to detect ignition of the respective gas burner, wherein the controller is configured to confirm activation of each of the first and second gas burners in response to detecting ignition of each of the first and second gas burners with the respective ignition sensors for the first and second gas burners during activation of each of the first and second gas burners.

6. The cooking appliance of claim 1, wherein each of the plurality of gas valves is a dedicated gas valve, the cooking appliance further comprises a shared gas valve in fluid communication with a gas supply and with each of the plurality of dedicated gas valves, and the controller is configured to activate the first gas burner by:

activating the shared gas valve and the respective dedicated gas valve for the first gas burner to supply gas from the gas supply to the first gas burner; and concurrently activating all of the plurality of igniters while gas is supplied to the first gas burner.

7. The cooking appliance of claim 1, wherein the controller is configured to, during a first iteration of the multiple iterations performed when reestablishing the temperature setpoint, sequentially activate the first and second gas burners.

8. The cooking appliance of claim 1, wherein the controller is configured to, during a first iteration of the multiple iterations performed when reestablishing the temperature setpoint, activate the first gas burner for a first predetermined activation duration, and activate the second gas burner for a second predetermined activation duration.

9. The cooking appliance of claim 1, wherein the controller is configured to, during a first iteration of the multiple iterations performed when reestablishing the temperature setpoint, activate the first gas burner until a temperature in the oven cavity reaches a predetermined temperature, and activate the second gas burner for a predetermined activation duration.

10. The cooking appliance of claim 1, wherein the controller is configured to, during a first iteration of the multiple iterations performed when reestablishing the temperature setpoint, activate the first gas burner until a temperature in the oven cavity reaches a first predetermined temperature, and activate the second gas burner until the temperature in the oven cavity reaches a second predetermined temperature.

11. The cooking appliance of claim 1, wherein the multiple iterations includes at least first and second iterations, and wherein the controller is configured to, during the second iteration, vary an activation sequence, an actuation overlap, a predetermined activation duration of the first gas burner, a predetermined activation duration of the second gas burner, a predetermined temperature at which to deactivate the first gas burner, or a predetermined temperature at which to deactivate the second gas burner relative to the first iteration.

12. The cooking appliance of claim 1, further comprising at least one non-gas cooking element disposed in the oven cavity, wherein the controller is further configured to activate the non-gas cooking element when reestablishing the temperature setpoint.

13. The cooking appliance of claim 1, wherein the controller is configured to, during a first iteration of the multiple iterations performed when reestablishing the temperature setpoint, overlap activation of the first and second gas burners during at least a portion of the first iteration.

14. The cooking appliance of claim 1, wherein the cooking cycle is a bake cycle, a convection bake cycle, or a convection roast cycle.

15. A cooking appliance, comprising:

a housing including an oven cavity;

a plurality of gas burners configured to generate heat within the oven cavity;

a plurality of gas valves, each gas valve in fluid communication with a respective gas burner among the plurality of gas burners;

a plurality of igniters, each igniter positioned proximate to a respective gas burner among the plurality of gas burners and configured to ignite gas supplied to the respective gas burner; and a controller coupled to the plurality of dedicated gas valves and the plurality of igniters, the controller configured to control the plurality of gas valves and the plurality of igniters to maintain a temperature setpoint during a cooking cycle, the controller further configured to reestablish the temperature setpoint during the cooking cycle by controlling the plurality of gas valves and the plurality of igniters to activate each of first and second gas burners among the plurality of gas burners for respective first and second predetermined activation durations.

16. The cooking appliance of claim 15, wherein the first gas burner is a bake gas burner disposed proximate a bottom of the oven cavity and the second gas burner is a broil gas burner disposed proximate a top of the oven cavity.

17. The cooking appliance of claim 15, wherein each of the plurality of igniters is a spark igniter.

18. The cooking appliance of claim 15, wherein the controller is configured to activate each of first and second gas burners among the plurality of gas burners for the respective first and second predetermined activation durations during a first iteration among a plurality of iterations performed to reestablish the temperature setpoint during the cooking cycle, and wherein the controller is further configured to activate each of the first and second gas burners during a second iteration among the plurality of iterations performed to reestablish the temperature setpoint during the cooking cycle.

19. The cooking appliance of claim 18, wherein the controller is configured to, during the second iteration, vary an activation sequence, an actuation overlap, a predetermined activation duration of the first gas burner, a predetermined activation duration of the second gas burner, a predetermined temperature at which to deactivate the first gas burner, or a predetermined temperature at which to deactivate the second gas burner relative to the first iteration.

20. A cooking appliance, comprising:

a housing including an oven cavity;

a plurality of gas burners configured to generate heat within the oven cavity;

a plurality of gas valves, each gas valve in fluid communication with a respective gas burner among the plurality of gas burners;

a plurality of spark igniters, each spark igniter positioned proximate to a respective gas burner among the plurality of gas burners and configured to ignite gas supplied to the respective gas burner; and a controller coupled to the plurality of dedicated gas valves and the plurality of igniters, the controller configured to control the plurality of gas valves and the plurality of spark igniters to maintain a temperature setpoint during a cooking cycle, the controller further configured to reestablish the temperature setpoint during the cooking cycle by controlling the plurality of gas valves and the plurality of spark igniters to activate each of first and second gas burners among the plurality of gas burners;

wherein the controller is configured to control the plurality of gas valves and the plurality of spark igniters to activate each of the first and second gas burners among the plurality of gas burners by activating the first gas burner for a first predetermined activation duration or until a temperature in the oven cavity reaches a first predetermined temperature, and activating the second gas burner for a second predetermined activation duration or until the temperature in the oven cavity reaches a second predetermined temperature that is different from the first predetermined temperature.

* * * * *